US009485590B2

(12) United States Patent
Cherigui

(10) Patent No.: US 9,485,590 B2
(45) Date of Patent: Nov. 1, 2016

(54) HEARING DEVICE WITH A MEANS FOR RECEIVER CURRENT ESTIMATION AND A METHOD OF ESTIMATING A RECEIVER CURRENT FOR A HEARING DEVICE

(75) Inventor: Fethi Cherigui, Zurich (CH)

(73) Assignee: SONOVA AG, Staefa (CH)

( * ) Notice: Subject to any disclaimer, the term of this patent is extended or adjusted under 35 U.S.C. 154(b) by 97 days.

(21) Appl. No.: 14/371,002

(22) PCT Filed: Jan. 18, 2012

(86) PCT No.: PCT/EP2012/050707

§ 371 (c)(1),
(2), (4) Date: Jul. 8, 2014

(87) PCT Pub. No.: WO2013/107506

PCT Pub. Date: Jul. 25, 2013

(65) Prior Publication Data

US 2014/0363006 A1 Dec. 11, 2014

(51) Int. Cl.
*H04R 25/00* (2006.01)
*H04R 29/00* (2006.01)

(52) U.S. Cl.
CPC ..... *H04R 25/50* (2013.01); *H04R 25/30* (2013.01); *H04R 2225/31* (2013.01); *H04R 2225/33* (2013.01); *H04R 2225/59* (2013.01); *H04R 2460/03* (2013.01)

(58) Field of Classification Search
None
See application file for complete search history.

(56) References Cited

U.S. PATENT DOCUMENTS 6,320,969 B1 11/2001 Killion
8,396,237 B2 * 3/2013 Schumaier ..... H04R 25/70 381/315
2004/0113590 A1 6/2004 Rosenquist
2014/0146971 A1 * 5/2014 Marguery ..... H04R 3/007 381/55

FOREIGN PATENT DOCUMENTS

DE 198 25 750 A1 1/2000
DE 10 2004 025 123 A1 7/2005
EP 2 293 599 A1 9/2011

(Continued)

OTHER PUBLICATIONS

International Search Report issued in Application No. PCT/EP2012/050707 dated Oct. 26, 2012.

(Continued)

*Primary Examiner* — Andrew L Sniezek
(74) *Attorney, Agent, or Firm* — Pearne & Gordon LLP

(57) ABSTRACT

A hearing device with a unit for estimating the current consumed by the receiver of the hearing device. The hearing device includes a signal input unit for converting an input signal picked up by the signal input unit into a digital audio signal, a signal processing unit for processing the digital audio signal, a digital-to-analog converter for converting a processed audio signal from the signal processing unit, a power amplifier for amplifying a converted audio signal from the digital-to-analog converter, a receiver for generating sound according to an amplified audio signal from the power amplifier, and a battery for powering the hearing device. A receiver current estimation unit has a filter for filtering a receiver current indicative signal derived from the processed audio signal, the filter having a frequency response dependent on an impedance of the receiver. A method is provided for estimating a receiver current for a hearing device.

16 Claims, 1 Drawing Sheet

(56) References Cited

FOREIGN PATENT DOCUMENTS

| | | | |
|---|---|---|---|
| WO | 2007/042026 | A1 | 4/2007 |
| WO | 2011/149928 | A1 | 12/2011 |

OTHER PUBLICATIONS

Written Opinion issued in Application No. PCT/EP2012/050707 dated Oct. 26, 2012.

* cited by examiner

HEARING DEVICE WITH A MEANS FOR RECEIVER CURRENT ESTIMATION AND A METHOD OF ESTIMATING A RECEIVER CURRENT FOR A HEARING DEVICE

TECHNICAL FIELD

The present invention relates to hearing devices and more specifically to hearing devices with a means for estimating the electrical current consumed by the receiver. Moreover, the present invention pertains to a method of estimating a receiver current of a hearing device as well as to uses of such a method.

BACKGROUND OF THE INVENTION

In the context of the present invention the term "hearing device" refers to hearing aids (alternatively called hearing instruments or hearing prostheses) used to compensate hearing impairments of hard of hearing persons as well as to audio and communication devices used to provide sound signals to persons with normal hearing capability, e.g. in order to improve hearing in harsh acoustic surroundings. Such hearing devices are miniature ear-level devices which typically are employed for extended periods of time and are powered by small battery cells such as a zinc air battery or increasingly by rechargeable batteries such as for instance a Nickel Metal Hydride (NiMH) accumulator. The power consumption of such a hearing device is preferably monitored in order to provide the user with timely notice that the battery needs to be replaced or recharged, i.e. by means of an "end of battery life" indicator. It is therefore an important requirement to have a reliable means by which the battery charge can be determined. This is typically done by voltage monitoring and level comparison. The component that drains the battery the most in such hearing devices is the receiver, i.e. the miniature loudspeaker that outputs sound waves to be perceived by the user of the hearing device. Hence, information regarding the current consumption of the receiver is a good basis for establishing the state of charge of the battery.

Hearing device batteries can be modelled as an ideal voltage source generating an open circuit voltage $V_{OC}$ in series with an internal resistance or battery impedance $R_{int}$. These are internal battery parameters which cannot be measured directly. However, the battery voltage $V_{Bat}$ across the battery terminals and the battery current $I_{Bat}$ provided by the battery are observable parameters. The internal parameters are linked to the observable ones via the linear relation $V_{Bat}=V_{OC}-R_{int}\cdot I_{Bat}$. Linear regression can thus be used to determine estimates of $V_{OC}$ and $R_{int}$, corresponding to the intercept point and the slope of the trace $V_{Bat}(I_{Bat})$, when the observable parameters $V_{Bat}$ and $I_{Bat}$ are known. The battery voltage $V_{Bat}$ can be measured directly and the battery current $I_{Bat}$ can be determined by inserting a shunt resistor between the battery and the load and measuring the voltage drop across the shunt resistor. In order to measure the receiver current a series resistor could be inserted either on the supply line of the class D power amplifier driving the receiver or in the branches of the power amplifier. However, adding a series resistor on the supply impacts the maximum power output (MPO) of the hearing device. In fact, the overall impedance on the supply up to the receiver inputs and including the power amplifier output should be minimised in order to support high power hearing devices.

SUMMARY OF THE INVENTION

It is therefore an object of the present invention to provide a means for receiver current estimation in a hearing device that avoids the above mentioned problem and thus allows to determine an estimate of the receiver current without impacting the maximum power output of the hearing device. This object is achieved by a hearing device according to the claims.

Moreover, it is a further goal of the present invention to provide an improved method of estimating the receiver current for a hearing device. This aim is achieved by the method according to the claims.

Preferred embodiments of the hearing device and method according to the present invention are given in the dependent claims.

Additionally, the claims provide inventive uses of the method according to the invention.

The current consumption of the receiver driven by a (class D) power amplifier is a function of the power amplifier supply voltage $V_{BatPA}$ as well as of both the amplitude and frequency of the audio signal applied to the power amplifier.

The present invention provides a hearing device comprising a signal input means for converting an input signal picked up by the signal input means into a digital audio signal, a signal processing unit for processing the digital audio signal, a digital-to-analog converter for converting a processed audio signal from the signal processing unit, a power amplifier for amplifying a converted audio signal from the digital-to-analog converter, a receiver for generating sound according to an amplified audio signal from the power amplifier, and a battery for powering the hearing device, characterised in that the hearing device further comprises a receiver current estimation unit comprising a filter for filtering a receiver current indicative signal derived from the processed audio signal, the filter having a frequency response H(f) which is dependent on an impedance Z(f) (or admittance Y(f)=1/Z(f)) of the receiver.

In an embodiment of the hearing device the amplitude response |H(f)| of the filter is approximately dependent on the impedance Z(f) of the receiver as given by the relation: $|H(f)|\approx\sqrt{|Z(f)|^{-1}}$.

In a further embodiment of the hearing device coefficients c(f) of the filter are approximately dependent on the impedance Z(f) of the receiver as given by the relation: $c(f)\approx|Z(f)|^{-1}$.

In a further embodiment of the hearing device the filter is an eighth or higher order filter. An eighth order filter is sufficient for estimating the receiver current with an accuracy of ±10%.

In a further embodiment of the hearing device the filter comprises at least four second-order sections, more commonly referred to as biquads.

In a further embodiment of the hearing device the receiver current estimation unit further comprises an analog-to-digital converter for measuring a supply voltage $V_{BatPA}$ of the power amplifier.

In a further embodiment of the hearing device the receiver current estimation unit further comprises an averaging unit for averaging the output signal from the analog-to-digital converter and a multiplier for multiplying the output signal from the averaging unit with a signal dependent on an output of the filter.

In a further embodiment of the hearing device the receiver current estimation unit further comprises a squaring unit for squaring the output signal of the filter.

In a further embodiment of the hearing device the receiver current estimation unit also comprises a second averaging unit for averaging the output signal from the squaring unit.

In a further embodiment of the hearing device the receiver current estimation unit is adapted to determine an estimate of the receiver current $I_{est}(f)$ based on the following formula:

$$I_{est}(f) = V_{BatPA} \cdot \frac{1}{N} \sum_{n=0}^{N} H(f) \cdot |s(n)|^2,$$

wherein $V_{BatPA}$ is the supply voltage of the power amplifier, preferably an average value of the supply voltage of the power amplifier, s(n) are discrete-time samples of the receiver current indicative signal, and N is the number of discrete-time samples processed to determine a value of the estimate of the receiver current $I_{est}(f)$.

In a further embodiment of the hearing device the receiver current indicative signal is a down-sampled version of the processed audio signal extracted from within the digital-to-analog converter.

Moreover, the present invention provides a method of estimating a receiver current for a hearing device powered by a battery, comprising the steps of:

converting an input signal picked up by a signal input means into a digital audio signal;

processing the digital audio signal by a signal processing unit;

converting a processed audio signal from the signal processing unit by a digital-to-analog converter;

amplifying a converted audio signal from the digital-to-analog converter by a power amplifier;

generating sound according to an amplified audio signal from the power amplifier by a receiver; and filtering by a filter a receiver current indicative signal derived from the processed audio signal, the filter having an amplitude response |H(f)| which is approximately dependent on the impedance Z(f) of the receiver as given by the relation: $|H(f)| \approx \sqrt{|Z(f)|^{-1}}$.

In an embodiment the method further comprises the steps of:

determining a value of a supply voltage $V_{BatPA}$ of the power amplifier, preferably an average value of the supply voltage $V_{BatPA}$ of the power amplifier; and multiplying a signal dependent on an output of the filter with the value of the supply voltage $V_{BatPA}$ of the power amplifier, preferably the average value of the supply voltage $V_{BatPA}$ of the power amplifier.

In a further embodiment of the method the steps are performed in order to evaluate the following formula:

$$I_{est}(f) = V_{BatPA} \cdot \frac{1}{N} \sum_{n=0}^{N} H(f) \cdot |s(n)|^2,$$

wherein s(n) are discrete-time samples of the receiver current indicative signal, and N is the number of discrete-time samples processed to determine a value of an estimate of the receiver current $I_{est}(f)$.

In a further embodiment of the method coefficients c(f) of the filter are determined by the steps of:

applying a signal with a certain peak value ŝ and a certain frequency f to the receiver;

measuring a receiver current $I_{meas}(\hat{s}, f)$;

repeating the previous two steps for different peak values $\hat{s}_i$ at multiple frequencies $f_j$; and solving a linear least-squares problem on the following set of equations:

$$\underbrace{\begin{bmatrix} I_{meas}(\hat{s}_{min}, f_{min}) & \dots & I_{meas}(\hat{s}_{min}, f_{max}) \\ \vdots & \ddots & \vdots \\ I_{meas}(\hat{s}_{max}, f_{min}) & \dots & I_{meas}(\hat{s}_{max}, f_{max}) \end{bmatrix}}_{I_{meas}} = \underbrace{\frac{1}{2} \cdot V_{BatPA} \cdot \begin{bmatrix} \hat{s}_{min}^2 \\ \vdots \\ \hat{s}_{max}^2 \end{bmatrix}}_{A} \cdot \underbrace{[c(f_{min}) \ \dots \ c(f_{max})]}_{c},$$

or equivalently $$c = \frac{I_{meas}}{A},$$

wherein c is a vector of filter coefficients c(f), which are to be determined, $I_{meas}$ is a matrix of measured receiver currents and A is a matrix of amplitude values.

In a further embodiment of the method coefficients c(f) of the filter are determined by the steps of:

measuring the impedance Z(f) of the receiver at multiple frequencies $f_j$; and computing the coefficients c(f) of the filter based on the relation: $c(f) \approx |Z(f)|^{-1}$.

In a further embodiment of the method the filter is a recursive filter, the method further comprising determining coefficients of the recursive filter based on the Yule-Walker method.

In a further embodiment of the method frequency characteristics of the filter are determined individually for the specific receiver utilised in the hearing device prior to regular operation of the hearing device by a user of the hearing device.

Additionally, an inventive use is provided of the methods according to the present invention as part of a method for determining a state of charge of a battery powering a hearing device.

A further inventive use is provided of the methods according to the present invention as part of a method for determining a correct functioning of a hearing device having been provided with specific settings by comparing an estimate of a receiver current determined during operation of the hearing device using the specific settings with a predetermined value of the receiver current known to be correct for the hearing device using the specific settings.

Yet a further inventive use is provided of the methods according to the present invention as part of a method for failure analysis of a malfunctioning hearing device, wherein logged estimates of the receiver current are analysed in order to determine irregularities that could possibly be the cause of the malfunctioning of the hearing device.

Combinations of the individual embodiments mentioned above can give rise to even further embodiments of the present invention.

BRIEF DESCRIPTION OF THE DRAWINGS

The present invention is further explained with reference to the accompanying drawings illustrating exemplary embodiments which are to be considered in connection with the following detailed description. Consequently, the present invention can be more readily appreciated. What is shown in the figures is the following.

DETAILED DESCRIPTION OF THE INVENTION

Figure 1:
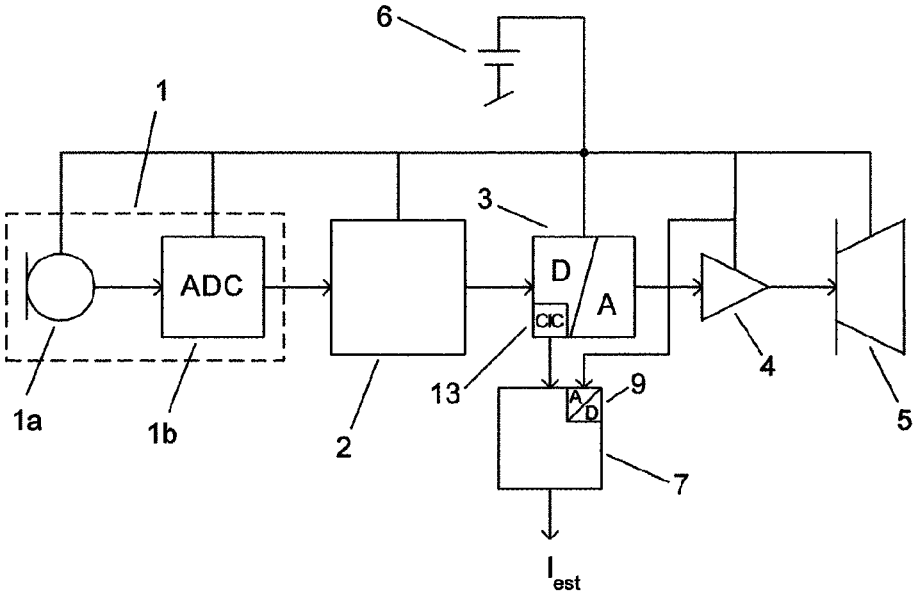
FIG. 1 depicts a schematic block diagram of a hearing device according to the present invention.

FIG. 1 shows a hearing device according to the present invention in a block diagram representation. The hearing device comprises a signal input means 1 such as a microphone 1*a* connected to an analog-to-digital converter (ADC) 1*b* for picking up an acoustic signal from the surroundings and converting it into a digital audio signal. Alternatively, the signal input means 1 could also comprise a telecoil (T-coil) for picking up an inductive signal or an FM (frequency modulation) receiver wirelessly connected to a remote microphone. The digital audio signal is subsequently processed by a signal processing unit 2. The processed audio signal output by the signal processing unit 2 is converted back to an analog signal by means of a digital-to-analog converter (DAC) 3. The DAC 3 can for instance comprise a digital decimation filter such as a CIC (cascaded integrator comb) decimator 13 (shown in FIG. 2) for down-sampling the digital audio signal, i.e. to reduce its sampling rate. The analog signal output by the DAC 3 is amplified by a power amplifier (PA) 4 and finally transformed into sound perceivable by the user of the hearing device by a receiver 5 (=miniature loudspeaker). All these components are powered by a battery 6 which for instance is rechargable. The hearing device further comprises a receiver current estimation unit 7. The goal of the receiver current estimation unit 7 is to estimate the root-mean-square (RMS) current consumption of the receiver 5. The latter is a (non-linear) function of the power amplifier supply voltage $V_{BatPA}$ as well as of both the amplitude and frequency of an audio signal s(n), i.e. a receiver current indicative signal, from the DAC path, e.g. the output of the CIC decimator 13 in the DAC 3.

The receiver current $I_{est}(f)$ can be approximated by the following formula:

$$I_{est}(f) = V_{BatPA} \cdot \frac{1}{N} \sum_{n=0}^{N} c(f) \cdot s^2(n),$$

where s(n) are discrete-time samples of the receiver current indicative signal, N is the length of a moving average, i.e. the number of discrete-time samples processed to determine an estimate $I_{est}(f)$ of the receiver current, and c(f) are filter coefficients. The filter coefficients c(f) reflect the frequency characteristic of the receiver impedance (or admittance). They are chosen such that the error between the estimated receiver current $I_{est}(f)$ and the actual (measured) receiver current $I_{meas}(f)$ is minimised. Assuming a sinusoidal signal s(n), $$\frac{1}{N} \sum_{n=0}^{N} s^2(n) \cong \frac{1}{2} \hat{s}^2,$$

where $\hat{s}$ is the peak value of the signal s(n). The coefficients c(f) can then be determined for each type of receiver 5, more preferably for each and every individual receiver 5, by the two schemes presented in the following.

Scheme I based on receiver current measurements:

If for example receiver current measurements are considered at four different signal input levels (e.g. $\hat{s}_{-6dBFS}=0.5$, $\hat{s}_{-9dBFS}=0.355$, $\hat{s}_{-12dBFS}=0.25$, $\hat{s}_{-15dBFS}=0.178$, where dBFS stands for Decibel full-scale) the following system of equations can be set up:

$$\begin{cases} I_{meas}(\hat{s}_{-15dBFS}, f) = V_{BatPA} \cdot c(f) \cdot \frac{1}{2} \hat{s}^2_{-15dBFS} \\ I_{meas}(\hat{s}_{-12dBFS}, f) = V_{BatPA} \cdot c(f) \cdot \frac{1}{2} \hat{s}^2_{-12dBFS} \\ I_{meas}(\hat{s}_{-9dBFS}, f) = V_{BatPA} \cdot c(f) \cdot \frac{1}{2} \hat{s}^2_{-9dBFS} \\ I_{meas}(\hat{s}_{-6dBFS}, f) = V_{BatPA} \cdot c(f) \cdot \frac{1}{2} \hat{s}^2_{-6dBFS} \end{cases}$$

or equivalently in matrix form:

$$\underbrace{\begin{bmatrix} I_{meas}(\hat{s}_{-15dBFS}, f_{min}) & \dots & I_{meas}(\hat{s}_{-15dBFS}, f_{max}) \\ I_{meas}(\hat{s}_{-12dBFS}, f_{min}) & \dots & I_{meas}(\hat{s}_{-12dBFS}, f_{max}) \\ I_{meas}(\hat{s}_{-9dBFS}, f_{min}) & \dots & I_{meas}(\hat{s}_{-9dBFS}, f_{max}) \\ I_{meas}(\hat{s}_{-6dBFS}, f_{min}) & \dots & I_{meas}(\hat{s}_{-6dBFS}, f_{max}) \end{bmatrix}}_{I_{meas}} =$$

$$\underbrace{\frac{1}{2} \cdot V_{BatPA} \cdot \begin{bmatrix} 0.178^2 \\ 0.25^2 \\ 0.355^2 \\ 0.5^2 \end{bmatrix}}_{A} \cdot \underbrace{[c(f_{min}) \ \dots \ c(f_{max})]}_{c}.$$

The linear least-squares problem $$c = \frac{I_{meas}}{A}$$

can then be solved for each type of receiver 5 to determine the coefficients c(f).

The receiver current measurements are performed by applying a digital input signal s(n) with given amplitude and frequency to the DAC 3. For instance, the signal frequency ranges from 100 Hz to 6350 Hz in steps of 250 Hz, and the signal amplitude is selected as −6 dBFS, −9 dBFS, −12 dBFS and −15 dBFS. A shunt resistance (e.g. 1Ω) is inserted between $V_{BatPA}$ (e.g. 1.3V) and the PA bridge. The voltage drop across the shunt resistor is amplified and low-pass filtered (cut-off ~15 kHz) using a sense amplifier and the true RMS current (AC+DC) is measured using an RMS meter. Such measurements should in fact be performed on each and every receiver 5 (or receiver type) to generate the measurement data to be used to compute the corresponding coefficients c(f). This can for instance be done during the manufacturing process of the hearing device.

The coefficients c(f) weight the frequency components of the input signal s(n) to give an estimate $I_{est}(f)$ of the receiver current. Thus the input signal s(n) needs to be applied to a filter 8 whose frequency response is $|H(f)|=\sqrt{c(f)}$ (square root because the input signal s(n) is filtered before being squared).

The Yule-Walker method is used to design the filter 8 to have the transfer function H(f). This method applies a least-squares technique to find the recursive filter coefficients c(f) such that the filter 8 matches the desired amplitude response |H(f)| given by $\sqrt{c(f)}$.

The order of the filter 8 has a great influence on the accuracy of the estimated receiver current. The higher the filter order, the better approximation of the actual receiver current is obtained. On the other hand it is desirable to minimise the number of coefficients c(f) in order to reduce implementation complexity, i.e. chip area and power consumption requirements. Therefore, a trade-off needs to be made between filter order and estimation accuracy. At least an eighth order recursive (IIR, infinite impulse response) filter is needed to achieve an acceptable accuracy of ±10%. The eighth order filter is split into four second-order sections or biquads.

Scheme II based on receiver impedance measurements:

The coefficients c(f) are dependent on the frequency characteristic of the receiver impedance Z(f) according to the following equation:

$$I_{est}(f) = V_{BatPA} \cdot \frac{1}{N} \sum_{n=0}^{N} \frac{1}{|Z(f)|} \cdot s^2(n).$$

Therefore, instead of measuring the receiver current $I_{meas}$ (f), calculating c(f) and designing the filter to have an amplitude response $|H(f)|=\sqrt{c(f)}$, the following different approach can alternatively be used: Measure the receiver impedance Z(f) using an impedance analyser and design the filter such that $|H(f)|\approx\sqrt{|Z(f)|^{-1}}$ using the same approach as previously described.

Figure 2:
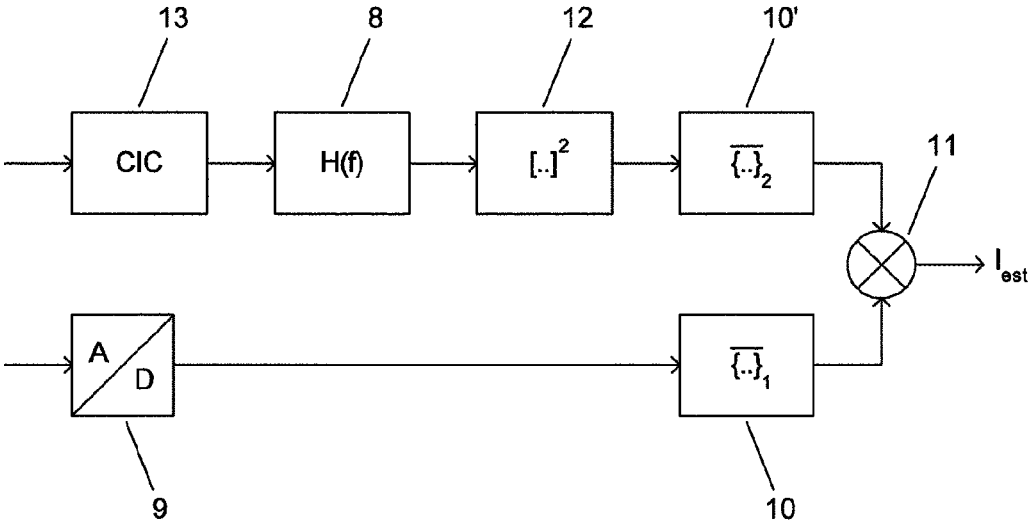
FIG. 2 depicts a schematic block diagram of a receiver current estimation unit according to the present invention.

FIG. 2 shows a receiver current estimation unit 7 according to the present invention in a block diagram representation. The receiver current estimation unit 7 implements the following equation:

$$I_{est}(f) = V_{BatPA} \cdot \frac{1}{N} \sum_{n=0}^{N} H(f) \cdot |s(n)|^2.$$

In the embodiment according to FIG. 2 the receiver current indicative signal s(n) is taken from the output of the CIC decimator 13. This signal is then applied to the filter 8 designed according to one of the methods presented above. The signal output by the filter 8 is squared in the squaring unit 12 and subsequently averaged in a (second) averaging unit 10'. Furthermore, an average of the supply voltage of the PA 4 is determined in the lower branch of the block diagram in FIG. 2. Samples of the supply voltage of the PA 4 $V_{BatPA}$ are first obtained by the analog-to-digital converter 9 and these are subsequently averaged by the (first) averaging unit 10. The outputs from the upper and lower branches of the block diagram in FIG. 2 are then multiplied with each other in the multiplier 11 to obtain an estimate $I_{est}$ of the receiver current.

An actual implementation of the receiver current estimation unit 7 described above employing a filter consisting of four biquads (yielding an $8^{th}$ order IIR filter) achieves an estimation accuracy within the range of ±10%. The required hardware in terms of silicon real estate is very small and the resulting current consumption very low, e.g. for an exemplary realisation based on 65 nm process technology the chip area is 0.045 $mm^2$ and the current consumption is 0.12 μA (for a processing time, i.e. an estimation time interval on the order of 3s). The proposed receiver current estimation unit 7 is therefore very well suited for on-chip integration together with other digital functional blocks of the hearing device, e.g. the signal processing unit 2 and a controller unit (not shown in the figures).

The method according to the present invention can be employed for a variety of different uses as outlined in the following.

$1^{st}$ Use: "Battery State of Charge (BSOC) Estimation"

The proposed receiver current estimation unit 7 can be implemented "on-chip" as part of integrated circuit in the hearing device for estimation of the battery state of charge (BSOC) without impacting the MPO of the hearing device. The BSOC concept is based on monitoring the battery internal parameters such as the battery impedance for accurate estimation of the battery state of health and the remaining battery operating time under well controlled load. This can be done by monitoring the battery observable parameters such as the load current $I_{Bat}$ and the battery supply voltage $V_{Bat}$.

$2^{nd}$ Use: "Hearing Device Acoustical Self-calibration and MPO Protection"

The proposed receiver current estimation unit 7 can be applied for on-chip high load prediction allowing automated hearing device parameter regulation, e.g. automatic adaptation of the digital signal processing (DSP) and DAC parameters. There is a strong correlation between the processed audio signal, the hearing device acoustical settings (including the DSP gain and MPO) and the related receiver current. High current load and receiver current peaks can be predicted using an appropriate averaging scheme and an adequately fast processing time in the receiver current estimation unit 7. Fast processing helps to foresee current peaks and short-term averaging aids in anticipating increased current consumption. This information together with the estimated battery impedance can be used to prevent a large battery voltage drop causing possible power intermittency, e.g. resulting in either hearing device shutdown or possible corruption of the hearing device state due to the high voltage requirement of the memories embedded in a hearing device's integrated circuits implemented using 65 nm process technology. Therefore, the predicted load can be used to adjust the DSP parameters in order to reduce the gain or limit the MPO as necessary.

$3^{rd}$ Use: "Power Management Regulation"

Optimal operating conditions of the power management depend on the battery state, i.e. voltage level and battery impedance, and on the load current. The receiver current is generally the largest contributor to the overall current consumption of a hearing device. Moreover, and as explained in respect of the $2^{nd}$ use above, large voltage drops may occur depending on the battery impedance, hearing device type and the receiver type used therein, the nature of the processed audio and the DSP acoustical settings. These voltage drops are generated by receiver current peaks and accentuated by the battery impedance. Such peaks can be predicted by the receiver current estimation unit 7 in order to set the power management into a mode (e.g. voltage boost) capable of sustaining the operating voltages required by the integrated circuit(s) in the hearing device, thereby preventing corruption of the hearing device state.

4th Use: "Hearing Device Current Profiling and Self-test"

Since the receiver current reflects the DSP acoustical settings of a hearing device, receiver current profiling as a function of the hearing device's acoustical settings and its mode of operation is a feature that can be useful for performing hearing device self-diagnostics and characterisation. Therefore, for a certain audio stimulus the estimated receiver current can be used to check the correctness of the DSP acoustical settings such as the gain and MPO.

$5^{th}$ Use: "Failure Analysis"

Receiver current data logging can be useful for later analysis of power related failures of a hearing device. Logging the battery internal parameters, the average hearing device current consumption and battery supply voltage is helpful for hearing device diagnosis and power related failure analysis. This is a very important feature since it helps in case of power intermittency. Power related failures require a failure analysis of the affected hearing devices in the lab. Such failures are related to the battery (including associated mechanical parts, e.g. the electrical contact, and the operating conditions, e.g. humidity) and receiver load under certain conditions. However, it is not easy to track (on the fly during normal operation of the hearing device) such factors at the end-user in order to explain such failures, and it is often very difficult to reproduce such failure effects in the lab. Therefore, receiver current data logging helps to track down the cause of such power related failures.

What is claimed is:

1. A hearing device comprising a signal input means (1) for converting an input signal picked up by the signal input means (1) into a digital audio signal, a signal processing unit (2) for processing the digital audio signal, a digital-to-analog converter (3) for converting a processed audio signal from the signal processing unit (2), a power amplifier (4) for amplifying a converted audio signal from the digital-to-analog converter (3), a receiver (5) for generating sound according to an amplified audio signal from the power amplifier (4), and a battery (6) for powering the hearing device, characterised in that the hearing device further comprises a receiver current estimation unit (7) comprising a filter (8) for filtering a receiver current indicative signal derived from the processed audio signal, the filter (8) having a frequency response H(f) which is dependent on an impedance Z(f) of the receiver (5) and an amplitude response |H(f)| of the filter (8) is approximately dependent on the impedance Z(f) of the receiver (5) as given by the relation: $|H(f)| \approx \sqrt{|Z(f)|^{-1}}$.

2. The hearing device of claim 1, wherein the filter (8) is an eighth or higher order filter.

3. The hearing device of claim 2, wherein the filter (8) comprises at least four biquads.

4. The hearing device of claim 1, wherein the receiver current estimation unit (7) further comprises an analog-to-digital converter (9) for measuring a supply voltage $V_{BatPA}$ of the power amplifier (4).

5. The hearing device of claim 4, wherein the receiver current estimation unit (7) further comprises an averaging unit (10) for averaging the output signal from the analog-to-digital converter (9) and a multiplier (11) for multiplying the output signal from the averaging unit (10) with a signal dependent on an output of the filter (8).

6. The hearing device of claim 1, wherein the receiver current estimation unit (7) further comprises a squaring unit (12) for squaring the output signal of the filter (8), and preferably also a second averaging unit (10') for averaging the output signal from the squaring unit (12).

7. The hearing device of claim 1, wherein the receiver current estimation unit (7) is adapted to determine an estimate of the receiver current $I_{est}(f)$ based on the following formula:

$$I_{est}(f) = V_{BatPA} \cdot \frac{1}{N} \sum_{n=0}^{N} H(f) \cdot |s(n)|^2,$$

wherein $V_{BatPA}$ is the supply voltage of the power amplifier (4), preferably an average value of the supply voltage of the power amplifier (4), s(n) are discrete-time samples of the receiver current indicative signal, and N is the number of discrete-time samples processed to determine a value of the estimate of the receiver current $I_{est}(f)$.

8. The hearing device of claim 1, wherein the receiver current indicative signal is a down-sampled version of the processed audio signal extracted from within the digital-to-analog converter (3).

9. A hearing device comprising a signal input means (1) for converting an input signal picked up by the signal input means (1) into a digital audio signal, a signal processing unit (2) for processing the digital audio signal, a digital-to-analog converter (3) for converting a processed audio signal from the signal processing unit (2), a power amplifier (4) for amplifying a converted audio signal from the digital-to-analog converter (3), a receiver (5) for generating sound according to an amplified audio signal from the power amplifier (4), and a battery (6) for powering the hearing device, characterised in that the hearing device further comprises a receiver current estimation unit (7) comprising a filter (8) for filtering a receiver current indicative signal derived from the processed audio signal, the filter (8) having a frequency response H(f) which is dependent on an impedance Z(f) of the receiver (5), wherein coefficients c(f) of the filter (8) are approximately dependent on the impedance Z(f) of the receiver (5) as given by the relation: $c(f) \approx |Z(f)|^{-1}$.

10. A method of estimating a receiver current for a hearing device powered by a battery (6), comprising the steps of:

converting an input signal picked up by a signal input means (1) into a digital audio signal;

processing the digital audio signal by a signal processing unit (2);

converting a processed audio signal from the signal processing unit (2) by a digital-to-analog converter (3);

amplifying a converted audio signal from the digital-to-analog converter (3) by a power amplifier (4);

generating sound according to an amplified audio signal from the power amplifier (4) by a receiver (5);

characterised in filtering by a filter (8) a receiver current indicative signal derived from the processed audio signal, the filter (8) having an amplitude response |H(f)| which is approximately dependent on the impedance Z(f) of the receiver (5) as given by the relation: $|H(f)| \approx \sqrt{|Z(f)|^{-1}}$.

11. The method of claim 10, further comprising the steps of:

determining a value of a supply voltage $V_{BatPA}$ of the power amplifier (4), preferably an average value of the supply voltage $V_{BatPA}$ of the power amplifier (4); and multiplying a signal dependent on an output of the filter (8) with the value of the supply voltage $V_{BatPA}$ of the power amplifier (4), preferably the average value of the supply voltage $V_{BatPA}$ of the power amplifier (4).

12. The method of claim 11, wherein the steps are performed in order to evaluate the following formula:

$$I_{est}(f) = V_{BatPA} \cdot \frac{1}{N} \sum_{n=0}^{N} H(f) \cdot |s(n)|^2,$$

wherein s(n) are discrete-time samples of the receiver current indicative signal, and N is the number of discrete-time samples processed to determine a value of an estimate of the receiver current $I_{est}(f)$.

13. The method of claim 10, wherein coefficients c(f) of the filter (8) are determined by the steps of:

applying a signal with a certain peak value ŝ and a certain frequency f to the receiver (5);

measuring a receiver current $I_{meas}(\hat{s}, f)$;

repeating the previous two steps for different peak values $\hat{s}_i$ at multiple frequencies $f_j$; and solving a linear least-squares problem on the following set of equations:

$$\underbrace{\begin{bmatrix} I_{meas}(\hat{s}_{min}, f_{min}) & \dots & I_{meas}(\hat{s}_{min}, f_{max}) \\ \vdots & \ddots & \vdots \\ I_{meas}(\hat{s}_{max}, f_{min}) & \dots & I_{meas}(\hat{s}_{max}, f_{max}) \end{bmatrix}}_{I_{meas}} = \underbrace{\frac{1}{2} \cdot V_{BatPA} \cdot \begin{bmatrix} \hat{s}_{min}^2 \\ \vdots \\ \hat{s}_{max}^2 \end{bmatrix}}_{A} \cdot \underbrace{[c(f_{min}) \ \dots \ c(f_{max})]}_{c},$$

-continued or equivalently $$c = \frac{I_{meas}}{A},$$

wherein c is a vector of filter coefficients c(f), which are to be determined, $I_{meas}$ is a matrix of measured receiver currents and A is a matrix of amplitude values.

14. The method of claim 13, wherein the filter (8) is a recursive filter, the method further comprising determining coefficients of the recursive filter based on a Yule-Walker method.

15. The method of claim 10, wherein coefficients c(f) of the filter (8) are determined by the steps of:

measuring the impedance Z(f) of the receiver (5) at multiple frequencies $f_j$; and computing the coefficients c(f) of the filter (8) based on the relation: $c(f) \approx |Z(f)|^{-1}$.

16. The method of claim 10, wherein frequency characteristics of the filter (8) are determined individually for the specific receiver (5) utilised in the hearing device prior to regular operation of the hearing device by a user of the hearing device.

* * * * *